United States Patent [19]

Lowe, Jr.

[11] Patent Number: 4,568,453

[45] Date of Patent: Feb. 4, 1986

[54] APPARATUS AND METHOD FOR REMOVING DUST FROM PARTICULATE MATERIAL

[76] Inventor: Henry E. Lowe, Jr., Cassopolis, Mich. 49031

[21] Appl. No.: 650,895

[22] Filed: Sep. 14, 1984

[51] Int. Cl.[4] ..... B07B 4/04

[52] U.S. Cl. ..... 209/135; 209/137; 209/149; 209/154

[58] Field of Search ..... 209/134, 135, 149, 153, 209/156, 136, 137, 147, 154

[56] References Cited

U.S. PATENT DOCUMENTS

| | | | |
|---|---|---|---|
| 13,382 | 3/1912 | Edison | 209/134 |
| 147,797 | 2/1874 | Schwab | 209/137 |
| 321,552 | 7/1885 | Wakeford | 209/149 X |
| 450,198 | 4/1891 | Shaw | 209/137 X |
| 805,559 | 11/1905 | Vandervoort | 209/137 |
| 1,085,921 | 2/1914 | Lakey | 209/136 |
| 1,419,437 | 6/1922 | Angers | 209/137 |
| 1,465,884 | 8/1923 | Vandervoort | 209/137 |
| 2,493,218 | 1/1950 | Bergstrom | 209/135 X |

FOREIGN PATENT DOCUMENTS

| | | |
|---|---|---|
| 309361 | 5/1929 | United Kingdom . |
| 316889 | 10/1930 | United Kingdom . |
| 394062 | 6/1933 | United Kingdom . |
| 515058 | 11/1939 | United Kingdom . |
| 548983 | 11/1942 | United Kingdom . |
| 558808 | 1/1944 | United Kingdom . |
| 588347 | 5/1947 | United Kingdom . |

*Primary Examiner*—Frank W. Lutter
*Assistant Examiner*—Thomas M. Lithgow
*Attorney, Agent, or Firm*—Marmaduke A. Hobbs

[57] ABSTRACT

Apparatus and method for removing dust from particulate material, utilizing a tower or column having a passage with a series of baffles on opposite sides over which the particulate material cascades while air is drawn across the flow path of the material to remove the dust dispersed in the material and adhering to the surface of the particles of material. Air is drawn across the passage from one side to the other by vacuum or suction from a vacuum pump or the like. In performing the method using the apparatus, the particulate material is introduced at the top of the column and permitted to cascade down through the vertical passage therein from one baffle to the next, and air is drawn inwardly between the baffles on one side and outwardly between the baffles on the opposite side of the column, and, as the air flows through the material cascading between the baffles, it removes the dust from the material. The apparatus can be used in conjunction with a storage bin, or with a conveyor which removes the material as it is discharged by the apparatus.

23 Claims, 8 Drawing Figures

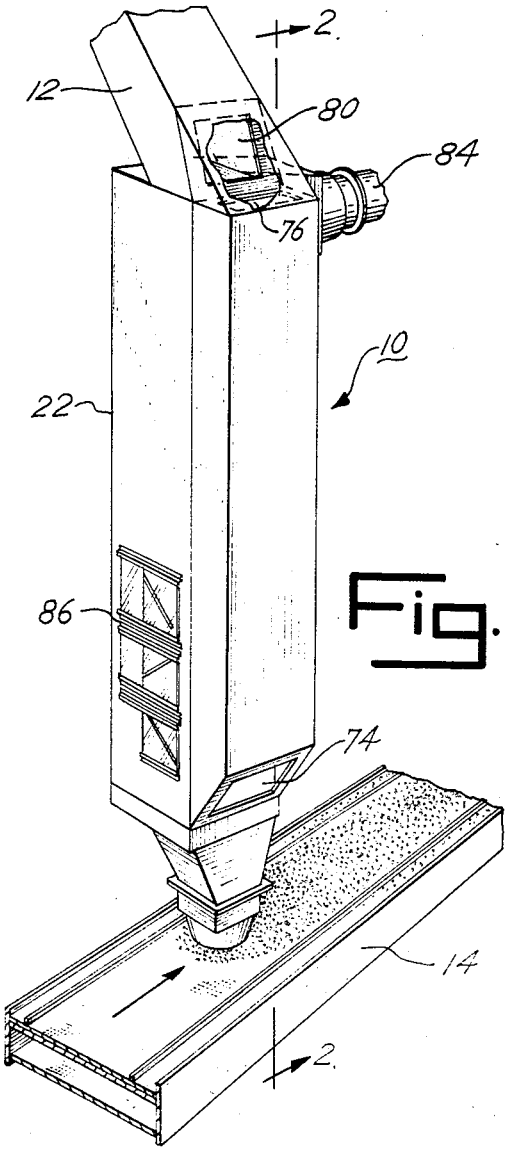
Fig.1
Fig.2
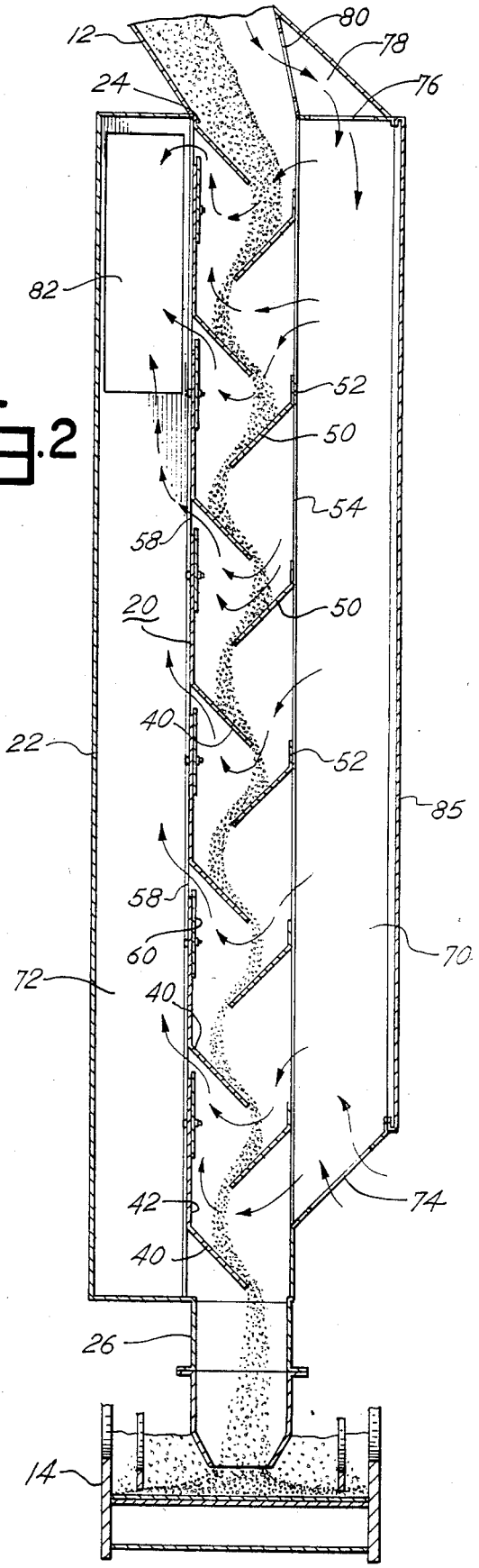

APPARATUS AND METHOD FOR REMOVING DUST FROM PARTICULATE MATERIAL

BACKGROUND OF THE INVENTION

Many particulate materials used in industry and in the home contain a substantial amount of dust which tends to become airborne when the material is transferred or transported in bulk or when carried on a conveyor or poured from a bag or other container, often creating an environmental condition hazardous to the health of workers in the vicinity, and/or producing an explosive mixture capable of destroying the facility handling the material. This condition is prevalent in the grain handling or milling industries and in the mining, quarrying and processing of minerals. While the dust in the particulate material is itself a particulate, for the purpose of the description herein, the particulate material of useful or desired size will be referred to as the "particulate material", and the undesirable or smaller particles which can readily become air-borne will be referred to as the "dust", the difference often being merely in the size of the particles, with the smaller particles being the component to be removed from the base particulate material.

In the clay industry, particulate material is prepared for a variety of uses, including oil and grease absorption and animal litters, wherein the clay is heated to drive off the moisture and then ground and graded to obtain a bulk material of substantially uniform particle size. In the processing of this material, it is first crushed and heated to drive off the moisture, and thereafter screened and stored in bulk and/or bagged or otherwise packaged for shipping. As the material passes through these various stages of the operation, dust, i.e. relatively small undesirable particles, is created in the particulate material from friction between the particles and/or contact of the particles with the equipment, thereby rendering the material less suitable for such uses as an oil absorbent or animal litter. The dust and/or useful particles may have an electro-static charge which causes the dust to adhere to the desirable particles, and hence interfere with the separation of the dust from those particles by conventional screening equipment. In the past, screens, cyclones, surfactants, air separators, or other air classification systems have been used or tried, but these systems have either been expensive to install and operate, have required excessive amounts of space in the production operation, or have not produced subtantially dust-free material.

SUMMARY OF THE INVENTION

It is one of the principal objects of the present invention to provide an apparatus which is relatively simple in construction and operation, and operates in an efficient and economical manner to remove the dust from particulate material, and which can readily be adapted to materials having different particulate or granular size and/or bulk density.

Another object of the invention is to provide an apparatus of the aforesaid type, which has no moving parts and can operate continuously over extended periods of time without servicing, and which can easily be maintained in optimum operating condition to give a consistent and stable performance.

A further object is to provide an apparatus for separating dust from particulate material, which is compact and can readily be adapted to normal or standard production lines, and which can conveniently be installed in existing bulk or conveyor systems.

Still another object of the invention is to provide a method for removing dust from particulate material, the steps of which can be integrated into existing production line or storage facilities and easily controlled to remove substantially all of the dust from the particulate, and which can effectively be performed economically in a relatively limited amount of space.

These and other objects, which will become apparent from the following description and accompanying drawings, are accomplished by the present invention, which utilizes a tower or column having a vertical passage with a series of alternate sloping baffles over which the particulate or granular material cascades while air is drawn across the flow path to remove the dust dispersed in the material and adhering to the surface of the particles of material. The baffles are disposed on opposite sides of the vertical passage in the column, and air is drawn across the passage from one side to the other by a vacuum or suction from a closely controlled source of low pressure, such as a vacuum pump at a dust collector. In performing the method using the foregoing apparatus, the particulate material is introduced at the top of the column and permitted to cascade down through the vertical passage therein from one baffle to the next, and air is drawn inwardly between baffles on one side and outwardly between the baffles on the opposite side of the column. The major portion of the dust to be removed occurs at the top of the column and the amount removed progressively decreases as the material descends in the column. The nature and quality of the material will determine the size of the apparatus or system to be used, particularly with reference to the length or height of the baffle column. Generally, the more dusty the material is, the larger the column should be in height, to provide a greater exposure of the material to the transverse air flow through the column. The present dust removing apparatus and method are applicable to most free-flowing materials, including grain, fertilizer, minerals, crushed rock, feeds, seeds, and powders such as granular soap materials.

BRIEF DESCRIPTION OF THE DRAWINGS

FIG. 1 is a perspective view of one embodiment of the dust removing apparatus, shown installed in conjunction with a conveyor system;

FIG. 2 is a vertical cross-sectional view of the apparatus, the section being taken on line 2—2 of FIG. 1;

DETAILED DESCRIPTION OF THE PREFERRED EMBODIMENT

Figure 3:
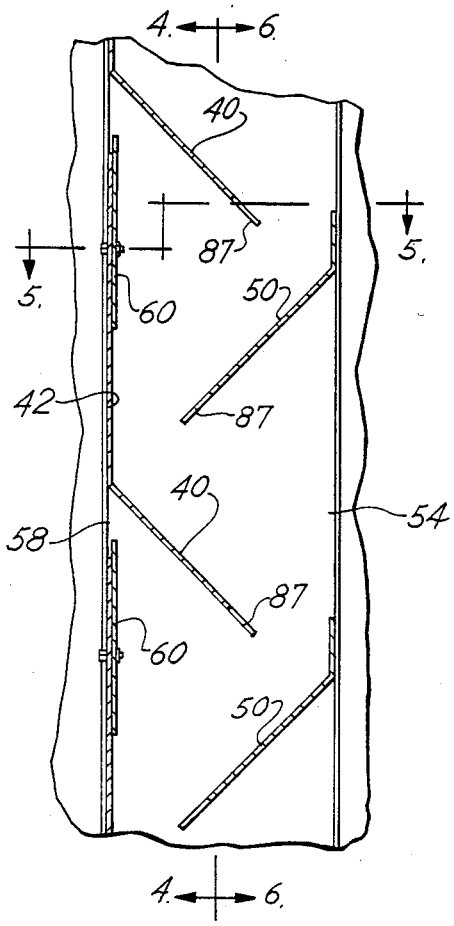
FIG. 3 is an enlarged, fragmentary, vertical cross-sectional view of the baffle column shown in FIG. 2.
Figure 4:
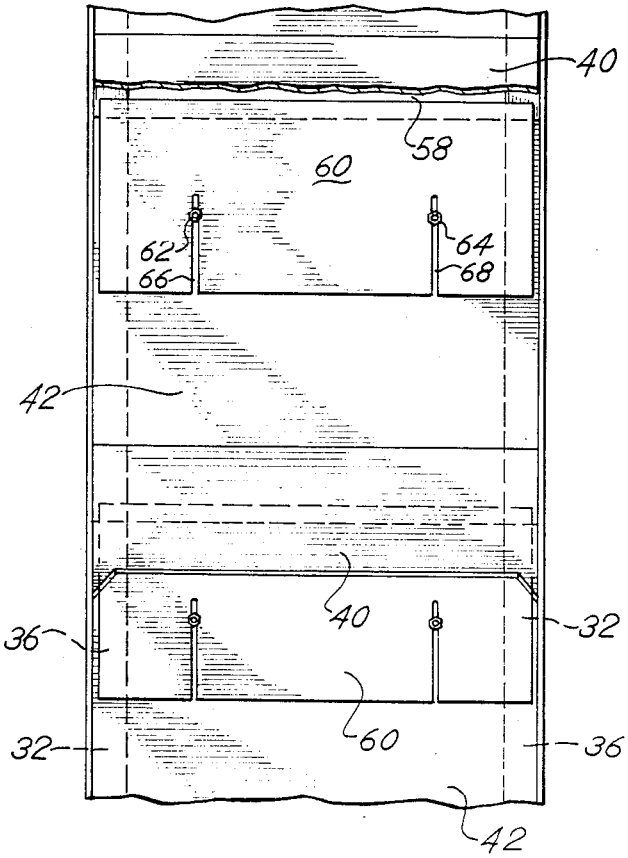
FIG. 4 is a vertical cross-sectional view of the baffle column shown in FIG. 3, the section being taken on line 4—4.

Referring more specifically to the drawings, and to FIGS. 1 through 6 in particular, numeral 10 designates generally an apparatus for removing dust from particulate material, embodying the present invention. Numeral 12 indicates a supply conduit for particulate material to be cleaned, and numeral 14 indicates a belt conveyor on which the cleaned particulate material is discharged for transporting to the next station in the processing operation, such as a bulk storage bin or a machine for bagging the material. The main dust removing operation is performed in a column, indicated generally by numeral 20, disposed in a housing 22, the column having material inlet passageway 24 at the top of the housing and material outlet passageway 26 at the bottom of the housing directly above belt conveyor 14. The column can be used with different types of equipment, as will be more fully explained hereinafter.

Figure 5:
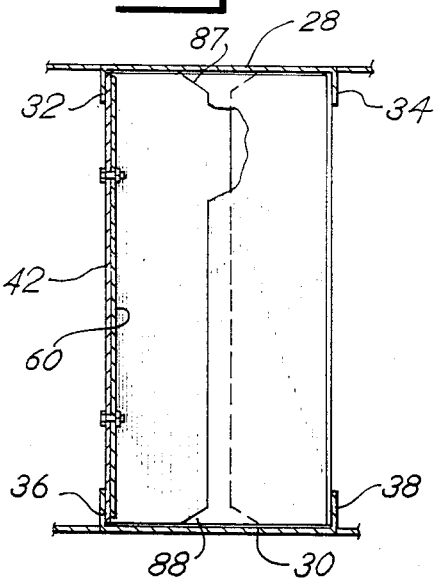
FIG. 5 is a horizontal cross-sectional view of the column shown in FIG. 3, the section being taken on line 5—5.
Figure 6:
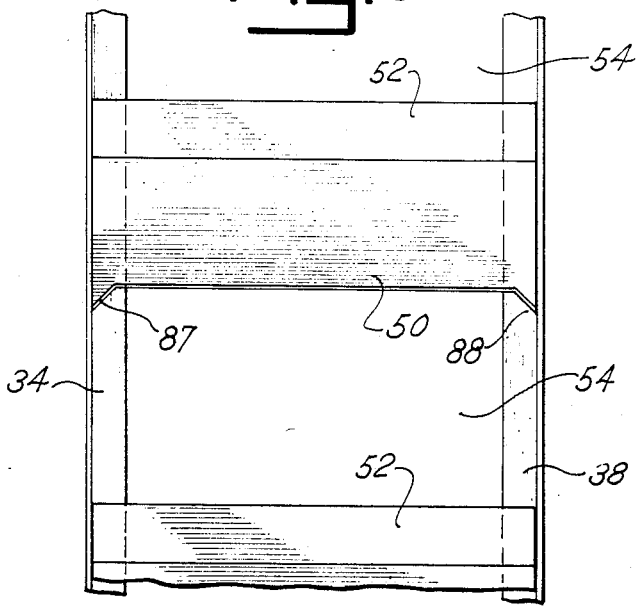
FIG. 6 is a vertical cross-sectional view of the column shown in FIG. 3, the section being taken on line 6—6.

The dust removing column consists of side members 28 and 30, seen in FIG. 5, side 28 having inwardly extending vertical flanges 32 and 34, and side 30 having inwardly extending vertical flanges 36 and 38. Connected to the inwardly extending flanges 32 and 36 are a plurality of baffles 40, each of which has a panel 42 joined rigidly thereto and secured at its outer ends to inwardly extending flanges 32 and 36, thereby holding the baffles 40 firmly in place in column 20. Joined integrally to flanges 34 and 38 are a plurality of baffles 50, each having a panel 52 secured to flanges 34 and 38. The inner edges of baffles 50 are equally spaced between the inner edges of baffles 40. The baffles 40 and 50 slope downwardly and inwardly at approximately a 45° angle, and the edges of the two sets of baffles 40 and 50 overlap one another so that the particulate material introduced through inlet passageway 24 must follow a circuitous route from the inlet passageway at the top to the outlet passageway 26 at the bottom. Furthermore the lower edge of the baffle 50 is positioned principally above the upper edge of the next lower baffle 40 on the opposite side of the column. (FIG. 2) The two sides 28 and 30, the baffles 40 and 50, and the respective panels 42 and 52, form a rigid columnar structure which is essentially self-supporting and is normally constructed of sheet or plate steel of sufficient thickness and strength that it can be transported and installed as a unit.

In order to remove the dust from the particulate material, a flow of air is created across the path of the cascading material, the air passing through a series of inlet openings 54 between the upper edge of panel 52 and the lower side of the adjacent baffle 50. After entering openings 54, the air flows through the material and exits through a series of outlet openings 58 disposed between the upper edge of panels 42 and the lower side of the adjacent baffle 40. The air outlet openings 58 are substantially smaller in effective area than the air inlet openings 54. (FIG. 2) The effective size of openings 58 is controlled by a door 60 secured to each panel 42 by a pair of screws 62 and 64 extending through holes in the respective panel and through slots 66 and 68 in the door 60, the slots 66 and 68 permitting adjustment of the doors to decrease or increase the size of openings 58, and thereby assisting in controlling the amount of air passing transversely through the column from opening 54 and the particulate material to opening 58. Holes 58 are immediately below the underside of the baffles and are, preferably, completely above the lower inner edge of the respective baffles; thus, the dust-laden air passing through column 20 must flow upwardly to reach holes 58, thereby preventing or minimizing the discharge of the larger particles of the particulate material.

The housing contains an air inlet plenum or manifold 70 and an outlet plenum or manifold 72, the inlet plenum having an air inlet 74 at the bottom and an air inlet 76 at the top of the plenum. The opening 76 communicates with supply conduit 12 through passage 78 and opening 80; thus, the air which flows through openings 54 in column 20 enters plenum 70 at both the top and bottom of the air intake plenum. Outlet manifold 72 communicates with openings 58 and with outlet 82, and through conduit 84, with a vacuum or suction pump (not shown) which is connected to a dust collector (not shown). The vacuum or suction pump and dust collector are considered conventional, and are readily available on the market and, hence, are not described in detail herein. The column can readily be reached for service through a door 85 extending virtually the full length of intake plenum 70, the door being hinged along one side so that, when it is opened, it exposes most of one side of column 20. As seen in FIG. 1, one side of housing 22 has several windows, indicated generally by numeral 86, to permit an operator to observe the performance of the apparatus during operation, so that adjustments can be made to obtain and maintain optimum performance of the equipment.

To provide and maintain a uniform curtain of downwardly flowing particulate material over the full width of the baffles between the side walls 28 and 30 of the column, triangular tabs or projections 87 and 88 are provided at opposite corners at the inner edge of each baffle. These projections distribute the material effectively near the two side walls and prevent the formation of open or thin areas in the curtain, where the air can flow freely and at greater velocity than at the center of the curtain. When the openings or thin areas occur in the curtain, there is a tendency for the faster flowing air through those areas to remove larger or heavier particles than the slower flowing air where there are no openings or where the curtain is thicker. Thus, these projections, by maintaining substantially uniform distribution and flow of material over the inner edges of the baffles, prevent or minimize the removal from the curtain of particles of a size within the desired range, thereby rendering the dust removing operation more efficient and economical, with less loss of the basic particulate material.

In the use and operation of the embodiment of the present invention illustrated in FIGS. 1 through 6, dust-containing particulate material is fed through inlet passageway 24 of column 20, from which it cascades downwardly through the passage in the column, alternately from a baffle on one side to a baffle on the opposite side. As the material passes downwardly through the column from one baffle to another, air drawn through plenum 70 into the column passes from intake openings 54 through the curtain of falling particulate material, thereby removing the dust therefrom and carrying it to and through outlet openings 58 into outlet manifold 72. The dust-laden air in manifold 72 is drawn into outlet passage 82, thence through conduit 84 to the vacuum or suction pump and to a dust collector. The greater part of the dust is removed from the particulate material in the upper part of column 20; however, the cleaning action continues until the particulate material flows from the column into outlet passageway 26. The air-flow into plenum 70, through the column, and from the manifold 72, is indicated by arrows showing the air passing through openings 74 and 76 into the intake plenum, and thence through inlet openings 54 and through the material to outlet openings 58 and outlet manifold 72, from which it is drawn by the suction or vacuum to the dust collector. The cleaned material flows downwardly through outlet passageway 26 onto a moving conveyor belt, and is transported either to a storage bin or to the next step in the processing operation, such as a machine for bagging the cleaned particulate material. The volume of the particulate material flowing through the column 20, at any particular time, is controlled by a suitable valve means in conduit 12 or in the equipment thereabove, and the air flow through the column from inlet openings 54 to outlet openings 58 is controlled by suitable valves in conduit 84, or by regulation of the suction or vacuum pump. Air flow can also be regulated, within limits, by shifting doors 60 upwardly or downwardly to vary the size of openings 58.

Figure 7:
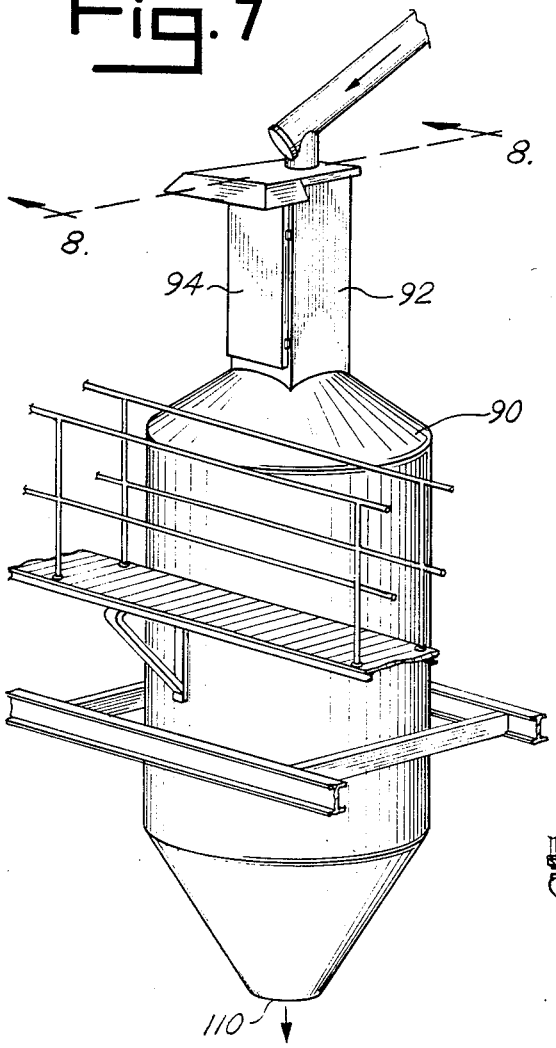
FIG. 7 is an elevational view of a bulk storage bin having the present apparatus installed therein.
Figure 8:
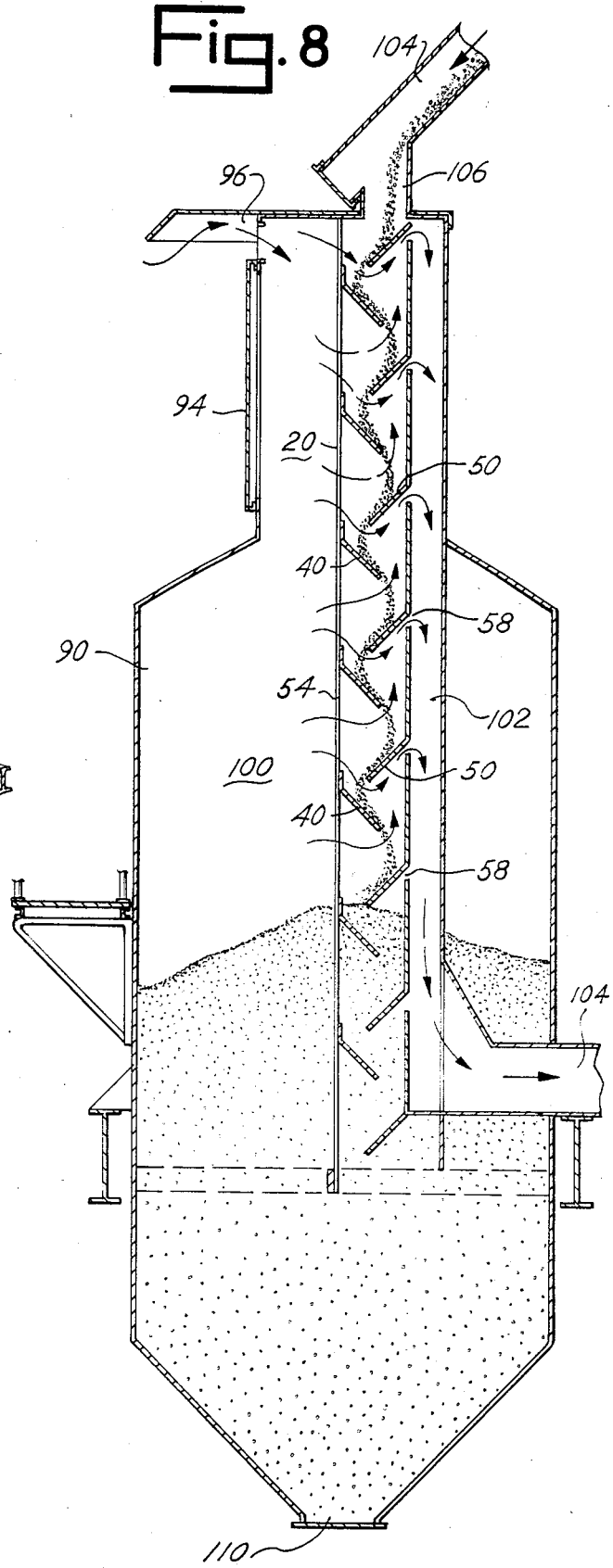
FIG. 8 is a vertical cross-sectional view of the system shown in FIG. 7, the section being taken on line 8—8.

The embodiment of the invention shown in FIGS. 7 and 8 involves a baffle column similar in most respects to the baffle column shown in the preceding figures; consequently, the same numerals will be used to identify similar parts in the column. In this embodiment, the dust removing column is used in conjunction with a bin 90, having a tower 92 with a door 94 therein for observing the operation and servicing the equipment. The air for openings 54 in the column enters the upper part of bin 90 through opening 96 in the upper end of tower 92 and passes downwardly into the inner chamber of the bin, and thence passes through the inlet openings 54, through the curtain of particulate material, and outwardly through outlet passages 58. The bin can be of different sizes and shapes and, in this embodiment, the bin serves as the air intake plenum for column 20, so that when the air flows through passage 96, it passes into chamber 100 of the bin, and thence is distributed to intake openings 54. The air then passes through the particulate material and outwardly through outlet passages 58 into a manifold 102 extending substantially the full length of the column. The manifold is connected to a suction or vacuum pump and dust collector by conduit 104 near the bottom of the column. The manifold is not connected to chamber 100 of the bin, except through the column, and, hence, the vacuum created in the manifold is effectively transmitted through the column to produce the desired air flow from chamber 100 to the manifold and thence to the dust collector. The particulate material is fed to the column through tube 104 and inlet passageway 106 at the top of the column. The material to be cleaned passes downwardly through the column and is discharged initially at the bottom of the bin, and, as the cleaned material accumulates in the bin and rises above the lower part of the column, the cleaned material then flows outwardly through openings 54 and continues to fill the bin. While the full capacity of the dust removing column is diminished as the material accumulates, this is normally not significant, in that the greater part of the dust is removed from the particulate material in the upper portion of the column. The cleaned material in the bin is removed from time-to-time through discharge opening 110 at the bottom of the bin.

The method of the present invention has been set forth in the description of the operation of the apparatus, with respect to both embodiments, and involves essentially causing the material to cascade downwardly through the column over the baffles, while subjecting the material to a transverse flow of air therethrough as the material falls from one baffle to another. In the embodiment of FIGS. 7 and 8, this operation is modified by the accumulation of cleaned material in the bin, in that the flow of the cleaned material from the column is diverted from the discharge end of the column to the openings 54 as the cleaned material accumulates in the bin.

It is seen that the present apparatus and method provide an effective way of removing dust from particulate material in an economical and convenient manner, in a relatively small amount of space. The only moving elements in the dust removing apparatus are the flow of the material being cleaned and the air flow through the material created by the vacuum or suction pump, which normally does not form a structural part of the apparatus. Thus, the apparatus can function effectively over long periods of time with little service or maintenance, and can be conveniently and effectively controlled to maintain optimum performance. While, as mentioned previously, the apparatus and method disclosed herein are primarily for use in removing the relatively small particles referred to herein as dust, which can easily become air-borne, from the relatively large particles of the base particulate, both the apparatus and method can be used to separate different size and/or density particles from one another, even though the small size particles may not normally be classified as dust particles. Hence, depending on the velocity of the transverse air flow, the apparatus and method can be used to screen and grade material according to size and/or density. As used in the claims, the term "dust" refers to the smaller of two particle sizes in a material, which normally can readily become air-borne, as distinguished from the larger particles of the material.

While only two embodiments of the apparatus and method for removing dust from particulate material have been described in detail herein, various changes and modifications may be made without departing from the scope of the present invention.

I claim:

1. An apparatus for removing dust from particulate material, comprising:

a. a vertically disposed column having a material flow passage therein and material inlet and outlet passageways near the top and bottom of said column passage, respectively;

b. alternately arranged baffles disposed on opposite sides of said passage, each having a downwardly and inwardly sloping portion with upper and lower edges, the lower edge of the baffle portion on one side of the column being positioned principally above the upper edge of the next lower baffle portion on the opposite side of the column;

c. air intake openings disposed between said baffles on one side of said passage and extending from a point adjacent the upper edge of one baffle portion to a point adjacent the upper edge of the baffle portion immediately above the respective opening to provide a substantially unrestricted opening from one baffle to the other;

d. air outlet openings disposed between said baffles on the opposite side of said passage and having upper and lower edges, the upper edge of each of said outlet openings being disposed adjacent the upper edge of the sloping baffle portion immediately above the respective outlet opening, and the lower edge of each of said outlet openings being disposed above a horizontal plane at the lower edge of said respective sloping baffle portion, the air outlet openings being substantially smaller in effective area than said air intake openings;

e. a manifold means connected to said outlet openings;

f. a vacuum source; and g. means for connecting said manifold means to said source of vacuum for creating a flow of air from said intake openings to said outlet openings through particulate material flowing downwardly in said column passage from one baffle to another to remove dust from the material.

2. An apparatus for removing dust from particulate material as defined in claim 1, in which said baffles on each side of said passage extend beyond the center of said passage and are spaced from the opposite side of said passage so that said material flowing through said passage must fall alternately from one baffle to another baffle.

3. An apparatus for removing dust from particulate material as defined in claim 2, in which said baffles are disposed at a downwardly and inwardly extending angle of approximately 45°.

4. An apparatus for removing dust from particulate material as defined in claim 1, in which projections are provided at the lower lateral corners of said baffle portions for assisting in controlling the flow of material from one baffle portion to the other.

5. An apparatus for removing dust from particulate material as defined in claim 4, in which said projections are tapered laterally outward from the inner edges of the respective baffle portions to form tabs of a generally triangular shape.

6. An apparatus for removing dust from particulate material as defined in claim 1, in which a plenum is connected with said intake openings and has port means connected to a source of air.

7. An apparatus for removing dust from particulate material as defined in claim 6, in which said port means includes an opening near the bottom of said plenum and a passage near the top of said plenum.

8. An apparatus for removing dust from particulate material as defined in claim 7, in which said port means near the top of said plenum includes a conduit means connecting the upper part of said plenum to said passageway at the top of said column passage.

9. An apparatus for removing dust from particulate material as defined in claim 6, in which said plenum is a storage bin for the cleaned particulate material.

10. An apparatus for removing dust from particulate material as defined in claim 9, in which said column is disposed in said bin, and said air intake openings in said column occupy the major part of the space between said baffles on the respective side of said column and serve as a discharge port for the cleaned material.

11. An apparatus for removing dust from particulate material as defined in claim 6, in which a valve means is provided for adjusting the size of said outlet openings for controlling the flow of air through said column passage.

12. An apparatus for removing dust from particulate material as defined in claim 1, in which a valve means is provided for adjusting the size of said outlet openings for controlling the flow of air through said column passage.

13. An apparatus for removing dust from particulate material as defined in claim 12, in which said means for connecting said manifold to a source of vacuum is connected to said manifold near the upper end thereof.

14. An apparatus for removing dust from particulate material as defined in claim 1, in which said means for connecting said manifold to a source of vacuum is connected to said manifold near the upper end thereof.

15. An apparatus for removing dust from particulate material, comprising:

a. a vertically disposed column having a material flow passage therein and material inlet and outlet passageways near the top and bottom of said column passage, respectively;

b. alternately arranged baffles disposed on opposite sides of said passage, each having a downwardly and inwardly sloping portion with upper and lower edges;

c. air intake openings between said baffles on one side of said passage extending adjacent the upper edge of the baffle portion to a point adjacent the upper edge of the baffle portion immediately above the respective opening to provide a substantially unrestricted opening from one baffle to the other;

d. air outlet openings, substantially smaller in effective area than said air intake openings, disposed between said baffles on the opposite side of said passage and having upper and lower edges, the upper edge of each of said outlet openings being disposed adjacent the upper edge of the sloping baffle portion immediately above the respective outlet opening, and the lower edge of each of said outlet openings being disposed above a horizontal plane at the lower edge of said respective sloping baffle portion; and e. means for creating a flow of air from said intake openings to said outlet openings through particulate material flowing downwardly in said column passage from one baffle to another to remove dust from the material.

16. An apparatus for removing dust from particulate material as defined in claim 15, in which a manifold means is connected to said outlet openings for receiving the dust-laden air from said outlet openings.

17. An apparatus for removing dust from particulate material as defined in claim 16, in which a plenum is connected with said intake openings and has port means connected to a source of air.

18. An apparatus for removing dust from particulate material as defined in claim 15, in which projections are provided at the lower lateral corners of said baffle portions for assisting in controlling the flow of material from one baffle portion to the other.

19. An apparatus for removing dust from particulate material as defined in claim 18, in which said projections are tapered laterally outward from the inner edges of the respective baffle portions to form tabs of a generally triangular shape.

20. A method of removing dust from particulate material, comprising:

a. passing the particulate material downwardly through a column having a series of spaced baffles on which the material successively falls, said baffles being arranged alternately from side-to-side and sloping inwardly and downwardly in overlapping relationship, with the lower edge of the baffle on one side of the column being positioned principally above the upper edge of the next lower baffle on the opposite side of the column, and with air inlet openings beneath the baffles on one side of the column and air outlet openings beneath the baffles on the opposite side, the inlet openings being of a size substantially larger than the size of said outlet openings;

b. subjecting the downwardly flowing material to a vacuum on the last mentioned opposite side of the column;

c. producing a generally transverse flow of air, at a relatively low velocity, from beneath each baffle on one side, thence through the downwardly flowing material as the material passes from one baffle to another, and then at a relatively high velocity, upwardly beneath the next lower baffle on the opposite side, to separate the dust from the particulate material; and d. removing the dust laden air from the flowing particulate material.

21. A method of removing dust from particulate material as defined in claim 20, in which said air flows first inwardly and downwardly between the baffles on one side and thence upwardly between the baffles on the opposite side in close proximity to the underside thereof, as the material passes from one baffle to another.

22. A method of removing dust from particulate material as defined in claim 21, in which said transverse flow of air is produced by subjecting said flowing material on to a vacuum on the opposite side of the column.

23. A method of removing dust from particulate material as defined in claim 20, in which said transverse flow of air is produced by subjecting said flowing material on to a vacuum on the opposite side of the column.

* * * * *